US007920115B2

(12) United States Patent
Park

(10) Patent No.: US 7,920,115 B2
(45) **Date of Patent: *Apr. 5, 2011**

(54) APPARATUS AND METHOD FOR DATA TRANSMISSION USING BIT MASKING AND BIT RESTORATION, AND APPARATUS AND METHOD FOR DRIVING IMAGE DISPLAY DEVICE USING THE SAME

(75) Inventor: Jae Hong Park, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 706 days.

This patent is subject to a terminal disclaimer.

(21) Appl. No.: 11/415,303

(22) Filed: May 2, 2006

(65) Prior Publication Data

US 2007/0070750 A1 Mar. 29, 2007

(30) Foreign Application Priority Data

Sep. 29, 2005 (KR) ..... 10-2005-0091416

(51) Int. Cl.
*G09G 3/36* (2006.01)

(52) U.S. Cl. ..... 345/89

(58) Field of Classification Search ..... None
See application file for complete search history.

(56) References Cited

U.S. PATENT DOCUMENTS

| | | | | |
|---|---|---|---|---|
| 4,382,298 | A * | 5/1983 | Evans | 714/709 |
| 6,310,564 | B1 * | 10/2001 | Fujimoto | 341/55 |
| 6,369,825 | B1 * | 4/2002 | Nakano | 345/562 |
| 2004/0179031 | A1 * | 9/2004 | Ando | 345/698 |
| 2005/0062764 | A1 * | 3/2005 | Park et al. | 345/690 |
| 2005/0163207 | A1 * | 7/2005 | Buckwalter et al. | 375/229 |
| 2005/0171991 | A1 * | 8/2005 | Zebedee | 708/801 |
| 2005/0188181 | A1 * | 8/2005 | Mar | 712/220 |

FOREIGN PATENT DOCUMENTS

| | | |
|---|---|---|
| CN | 1624752 A | 6/2005 |
| JP | 2000-207077 | 7/2000 |
| JP | 2004-361709 | 12/2004 |
| JP | 2005-173618 | 6/2005 |
| JP | 2005-204306 | 7/2005 |

* cited by examiner

*Primary Examiner* — Alexander Eisen
*Assistant Examiner* — Matthew Yeung
(74) *Attorney, Agent, or Firm* — McKenna Long & Aldridge LLP

(57) ABSTRACT

An apparatus and method for data transmission and an apparatus and method for driving an image display device using the same are disclosed, in which transition of data is minimized during data transmission to minimize electromagnetic interference. The apparatus for data transmission includes a data modulator modulating low bits excluding the most significant bit (MSB) in response to the MSB of input data, and a data restorer restoring the modulated data transmitted from the data modulator to their original data in response to the MSB. Since the low data bit excluding the MSB data are inverted in response to the MSB data of the input data, the number of times of data transition can be reduced to reach half, thereby minimizing electromagnetic interference.

35 Claims, 12 Drawing Sheets

APPARATUS AND METHOD FOR DATA TRANSMISSION USING BIT MASKING AND BIT RESTORATION, AND APPARATUS AND METHOD FOR DRIVING IMAGE DISPLAY DEVICE USING THE SAME

This application claims the benefit of the Korean Patent Application No. P05-91416, filed on Sep. 29, 2005, which is hereby incorporated by reference as if fully set forth herein.

BACKGROUND OF THE INVENTION

1. Field of the Invention

The present invention relates to an apparatus and method for data transmission, and more particularly, to an apparatus and method for data transmission and an apparatus and method for driving an image display device using the same, in which the transition of data values is minimized during data transmission to minimize electromagnetic interference.

2. Discussion of the Related Art

The trend in the information display industry is towards various flat panel displays that have reduced weight and volume compared to cathode ray tubes. Examples of such flat panel displays include liquid crystal displays (LCD), field emission displays (FED), plasma display panels (PDP), and light emitting displays (LED).

Notably, the LCD displays a picture image by controlling the light transmittance of liquid crystal cells depending on video signals. An active matrix type LCD is provided with switching elements formed in each liquid crystal cell and is suitable for displaying moving pictures. Thin film transistors (TFTs) are mainly used as the switching elements used for the active matrix type LCD.

FIG. 1 illustrates a related art apparatus for driving an LCD.

Referring to FIG. 1, the related art apparatus for driving an LCD includes an image display unit 2 including liquid crystal cells formed in each region defined by first to nth gate lines GL1 to GLn and first to mth data lines DL1 to DLm, a data driver 4 supplying analog video signals to the data lines DL1 to DLm, a gate driver 6 supplying scan pulses to the gate lines GL1 to GLn, and a timing controller 8 aligning source RGB data from external input to supply them to the data driver 4, generating data control signals DCS to control the data driver 4, and generating gate control signals GCS to control the gate driver 6.

The image display unit 2 includes a transistor array substrate, a color filter array substrate, a spacer, and a liquid crystal. The transistor array substrate and the color filter array substrate face each other and are bonded to each other. The spacer uniformly maintains a cell gap between the two substrates. The liquid crystal is filled in a liquid crystal area prepared by the spacer.

The image display unit 2 includes a TFT formed in the region defined by the gate lines GL1 to GLn and the data lines DL1 to DLm, and the liquid crystal cells connected to the TFT. The TFT supplies analog video signals from the data lines DL1 to DLm to the liquid crystal cells in response to the scan pulses from the gate lines GL1 to GLn. The liquid crystal cell is comprised of common electrodes facing each other with liquid crystal therebetween and pixel electrodes connected to the TFT. Therefore, the liquid crystal cell is equivalent to a liquid crystal capacitor Clc. The liquid crystal cell includes a storage capacitor Cst that retains the analog video signals filled in the liquid crystal capacitor Clc until the next analog video signals are filled therein.

The timing controller 8 aligns the externally input RGB source data to make it suitable for driving the image display unit 2 and supplies the aligned data to the data driver 4. Also, the timing controller 8 generates the data control signals DCS and the gate control signals GCS using a main clock MCLK, a data enable signal DE, and horizontal and vertical synchronizing signals Hsync and Vsync, which are externally input, so as to control each driving timing of the data driver 4 and the gate driver 6.

The gate driver 6 includes a shift register that sequentially generates scan pulses, i.e., gate high pulses in response to a gate start pulse (GSP) and a gate shift clock (GSC) among the gate control signals GCS from the timing controller. The gate driver 6 sequentially supplies the gate high pulses to the gate lines GL of the image display unit 2 to turn on the TFT connected to the gate lines GL.

The data driver 4 converts the data RGB aligned from the timing controller 8 into the analog video signals in response to the data control signals DCS supplied from the timing controller 8 and supplies to the data lines DL1 to DLm the analog video signals corresponding to one horizontal line per one horizontal period in which the scan pulses are supplied into the gate lines GL1 to GLn. In other words, the data driver 4 selects a gamma voltage having a predetermined level depending on a gray level value of the data RGB and supplies the selected gamma voltage to the data lines DL1 to DLm. At this time, the data driver 4 inverses polarity of the analog video signals supplied to the data lines DL in response to a polarity control signal (POL).

FIG. 2 illustrates a data transmission bus between the timing controller and the data driver shown in FIG. 1.

Referring to FIG. 2 in connection with FIG. 1, the timing controller 8 includes a control signal generator 22 generating the control signals DCS and GCS, and a data aligner 24 aligning the source data RGB and supplying the aligned data to the data driver 4.

The control signal generator 22 generates the gate control signals GCS (GSC, GSP and GOE) and the data control signals DCS (SSC, SSP, SOE and POL) using the main clock MCLK, the data enable signal DE, and the horizontal and vertical synchronizing signals Hsync and Vsync, which are externally input.

The gate control signals GCS are supplied to the gate driver 6 through respective transmission lines included in a gate control signal bus (not shown). The data control signals DCS are supplied to the data driver 4 through respective transmission lines included in a data control signal bus 12.

The data aligner 24 aligns the externally input RGB source data to be suitable for a bus transmission manner and synchronizes the aligned RGB data with a source shift clock (SSC) signal to supply the synchronized data to the data driver 4. For example, the data aligner 24 supplies the aligned RGB data to the data driver 4 through red, green and blue data buses 14, 16, and 18 as shown in Table 1. If the RGB source data are 6-data bit, each of the data buses 14, 16 and 18 is comprised of six data transmission lines. As a result, the number of the data transmission lines becomes 18.

TABLE 1

| | Bit Grey level | | | | | |
|---|---|---|---|---|---|---|
| | D5 | D4 | D3 | D2 | D1 | D0 |
| 0 | 0 | 0 | 0 | 0 | 0 | 0 |
| 1 | 0 | 0 | 0 | 0 | 0 | 1 |
| 2 | 0 | 0 | 0 | 0 | 1 | 0 |

TABLE 1-continued

| | Bit Grey level | | | | | |
|---|---|---|---|---|---|---|
| | D5 | D4 | D3 | D2 | D1 | D0 |
| 3 | 0 | 0 | 0 | 0 | 1 | 1 |
| . | . | . | . | . | . | . |
| . | . | . | . | . | . | . |
| . | . | . | . | . | . | . |
| 63 | 1 | 1 | 1 | 1 | 1 | 1 |

In Table 1, D0~D5 represent one of R, G, and B data values.

The timing controller 8 supplies data corresponding to one pixel (for example, 18 bits of respective 6 bits of R, G, and B) to the data driver 4 using eight data transmission lines 14, 16, and 18. However, if the data corresponding to one pixel are supplied from the timing controller 8 to the data driver 4, electromagnetic interference seriously occurs due to transition of the data.

For example, if the current pixel data has a bit value of "0" and the next pixel data has a bit value of "1", transition occurs in all the bits causing high electromagnetic interference. Particularly, if resolution and size of the image display unit increase, the problem electromagnetic interference becomes more serious.

SUMMARY OF THE INVENTION

Accordingly, the present invention is directed to an apparatus and method for data transmission and an apparatus and method for driving an image display device using the same, which substantially obviate one or more problems due to limitations and disadvantages of the related art.

An advantage of the present invention is to provide an apparatus and method for data transmission and an apparatus and method for driving an image display device using the same, in which transition of data is minimized during data transmission to minimize electromagnetic interference.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, an apparatus for data transmission includes a data modulator modulating low bits excluding the most significant bit (MSB) in response to the MSB of input data, and a data restorer restoring the modulated data transmitted from the data modulator to their original data in response to the MSB.

The data modulator includes a plurality of data input lines to which the input data are input, a plurality of first inverters inverting the low bits input to each of the data input lines, and a plurality of first selectors selecting one of the low bits from each of the data input lines and the low bit inversed by each of the first inverters in response to the MSB and outputting the selected one to a plurality of data transmission lines.

The data restorer includes a plurality of second inverters inverting the low bits transmitted to each of the data transmission lines, and a plurality of second selectors selecting one of the low bits from each of the data transmission lines and the low bit inversed by each of the second inverters in response to the MSB and restoring the selected one to the original data.

The data modulator modulates the low bits in response to the MSB using input masking data.

The data modulator includes a plurality of data input lines to which the input data are input, a plurality of masking data transmission lines supplied with the masking data, a plurality of first logic gates performing logic operation of the low bits input to each of the data input lines and the masking data, and a plurality of first selectors selecting one of the low bits from each of the data input lines and the low bit operated by each of the first logic gates in response to the MSB and outputting the selected one to a plurality of data transmission lines.

The data restorer includes a plurality of second logic gates performing logic operation of the low bits transmitted to each of the data transmission lines and the masking data, and a plurality of second selectors selecting one of the low bits from each of the data transmission lines and the low bit operated by each of the second logic gates in response to the MSB and restoring the selected one to the original data.

The first and second logic gates are exclusive OR gates.

In another aspect of the present invention, an apparatus for driving an image display device includes an image display unit including pixel cells formed in each region defined by a plurality of gate lines and a plurality of data lines, a timing controller modulating low bits excluding the MSB of externally input data in response to the MSB, a gate driver supplying scan pulses to the gate lines under the control of the timing controller, and a data driver restoring the modulated data transmitted from the timing controller to original data in response to the MSB and converting the restored data into analog video signals under the control of the timing controller to supply them to the data lines.

In still another aspect of the present invention, a method for data transmission includes modulating low bits excluding the MSB in response to the MSB of input data, and restoring the modulated data to their original data in response to the MSB.

In further still another aspect of the present invention, in a method for driving an image display device including pixel cells formed in each region defined by a plurality of gate lines and a plurality of data lines, the method includes modulating low bits excluding the MSB of externally input data in response to the MSB, restoring the modulated data to original data in response to the MSB, supplying scan pulses to the gate lines, and converting the restored data into analog video signals to synchronize with the scan pulses and supplying the analog video signals to the data lines.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
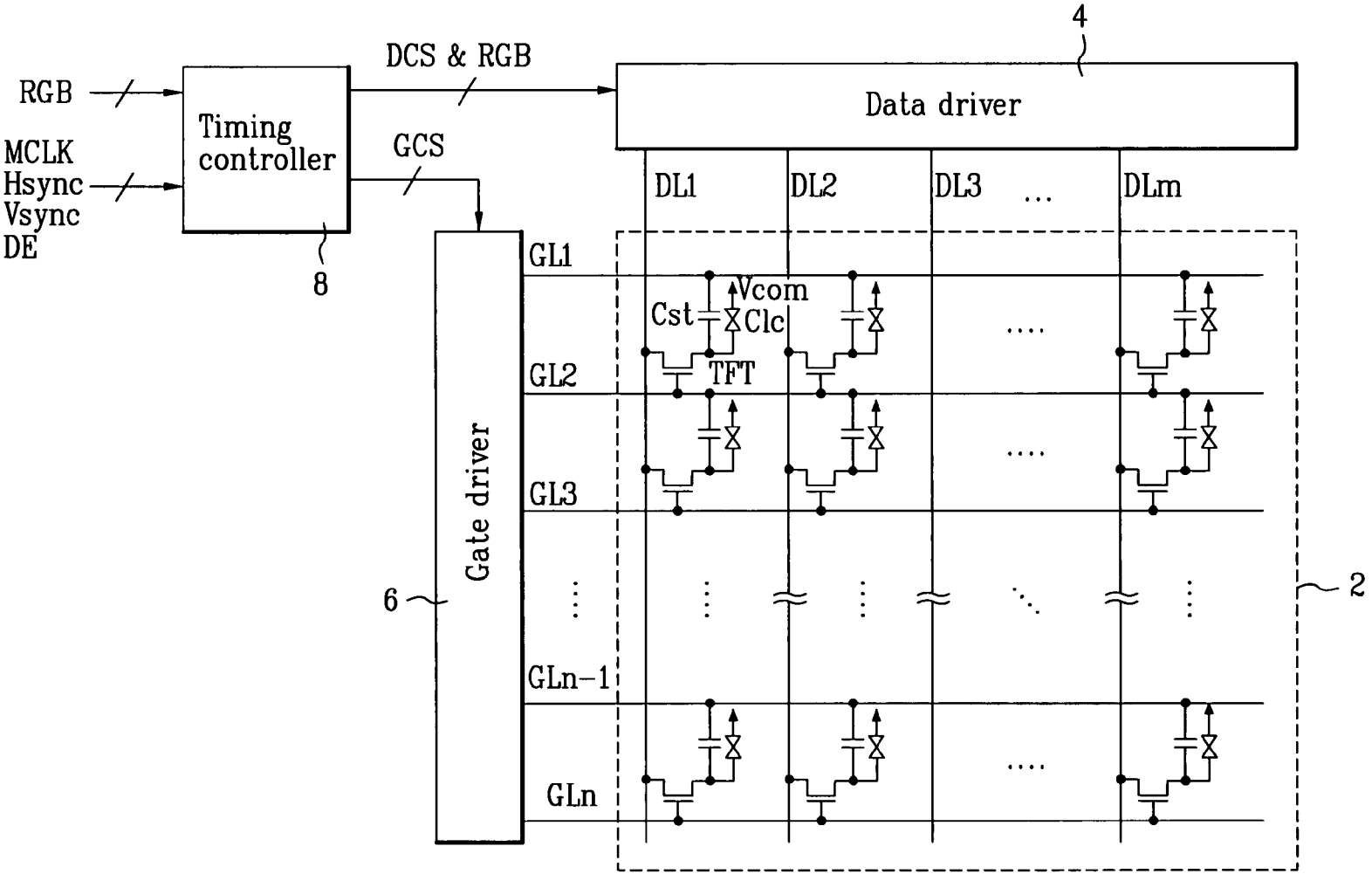
FIG. 1 Related Art
FIG. 1 illustrates a related art apparatus for driving an LCD.
Figure 2:
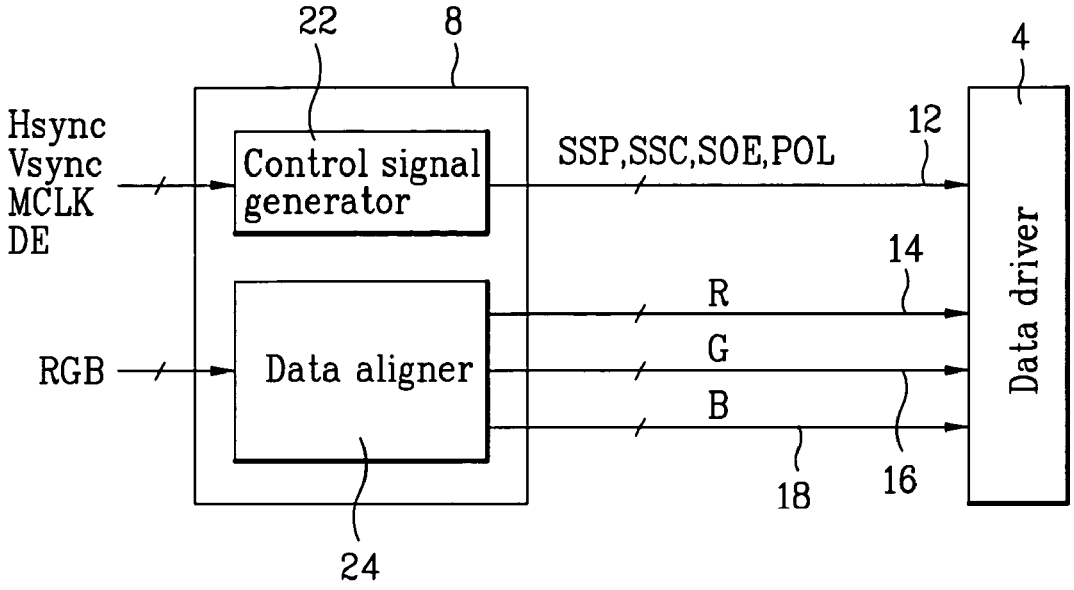
FIG. 2 Related Art
FIG. 2 illustrates data transmission between a timing controller and a data driver shown in FIG. 1.
Figure 3:
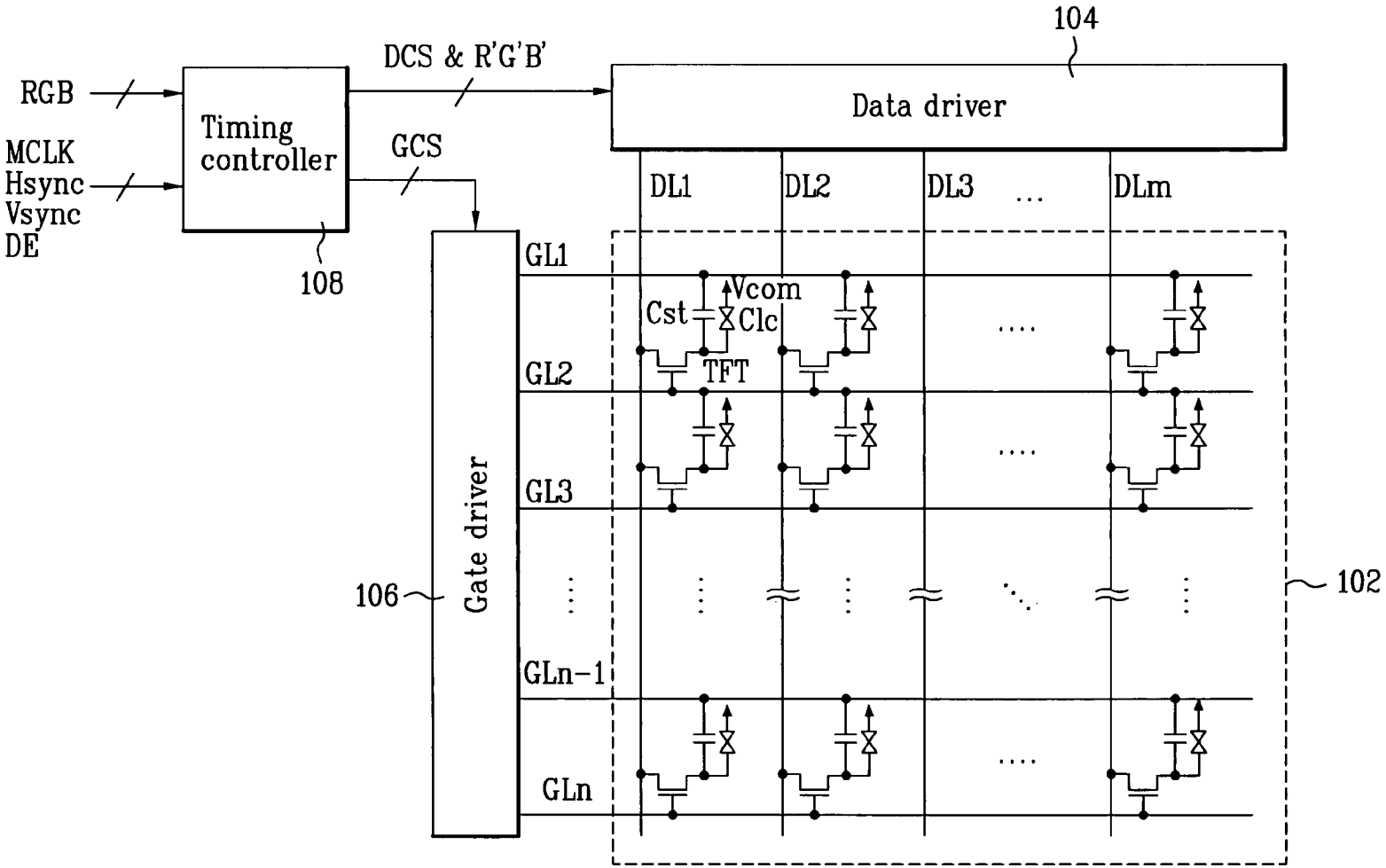
FIG. 3 illustrates an apparatus for data transmission and an apparatus for driving an image display device using the same according to the first embodiment of the present invention.

FIG. 3 illustrates an apparatus for data transmission and an apparatus for driving an image display device using the same according to the first embodiment of the present invention.

Referring to FIG. 3, the apparatus for data transmission and the apparatus for driving an image display device using the same according to the first embodiment of the present invention includes an image display unit 102 including liquid crystal cells formed in each region defined by first to nth gate lines GL1 to GLn and first to mth data lines DL1 to DLm, a timing controller 108 aligning externally input source data RGB and inverting low data bit excluding the most significant bit (MSB) in response to the MSB data of the aligned data RGB, a gate driver 106 supplying scan pulses to the gate lines GL1 to GLn under the control of the timing controller 108, and a data driver 104 restoring the data transmitted from the timing controller 108 to their original data in response to the MSB data and converting the restored data into analog video signals under the control of the timing controller 108 to supply them to the data lines DL1 to DLm.

The image display unit 102 includes a transistor array substrate, a color filter array substrate, a spacer, and a liquid crystal. The transistor array substrate and the color filter array substrate face each other and are bonded to each other. The spacer uniformly maintains a cell gap between the two substrates. The liquid crystal is filled in a liquid crystal area created by the spacer.

The image display unit 102 includes a TFT formed in the region defined by the gate lines GL1 to GLn and the data lines DL1 to DLm, and the liquid crystal cells connected to the TFT. The TFT supplies the analog video signals from the data lines DL1 to DLm to the liquid crystal cells in response to the scan pulses from the gate lines GL1 to GLn. The liquid crystal cell is comprised of common electrodes facing each other by interposing the liquid crystal therebetween and pixel electrodes connected to the TFT. Therefore, the liquid crystal cell is equivalent to a liquid crystal capacitor Clc. The liquid crystal cell includes a storage capacitor Cst that retains the analog video signals filled in the liquid crystal capacitor Clc until the next analog video signals are filled therein.

The timing controller 108 aligns the externally input RGB source data to make it suitable for driving of the image display unit 102, inverts the low data bit excluding the MSB data in response to the MSB data of the aligned data RGB to generate modulated data R'G'B', and supplies them to the data driver 104. For example, if the MSB data of the aligned data RGB is "0", the timing controller 108 transmits the aligned data RGB to the data driver 104. But if the MSB data of the aligned data RGB is "1", the timing controller 108 respectively inverses the low data bit excluding the MSB data of the aligned data RGB and supplies the inverted data to the data driver 104.

Also, the timing controller 108 generates data control signals DCS and gate control signals GCS using a main clock MCLK, a data enable signal DE, and horizontal and vertical synchronizing signals Hsync and Vsync, which are externally input, so as to control each driving timing of the data driver 104 and the gate driver 106.

The gate driver 106 includes a shift register that sequentially generates scan pulses, i.e., gate high pulses in response to a gate start pulse (GSP) and a gate shift clock (GSC) among the gate control signals GCS from the timing controller 108. The gate driver 106 sequentially supplies the gate high pulses to the gate lines GL of the image display unit 102 to turn on the TFT connected to the gate lines GL.

The data driver 104 converts the modulated data R'G'B' transmitted from the timing controller 108 to the analog video signals in response to the data control signals DCS supplied from the timing controller 108 and supplies to the data lines DL the analog video signals corresponding to one horizontal line per one horizontal period in which the scan pulses are supplied into the gate lines GL. In other words, the data driver 104 selects a gamma voltage having a predetermined level depending on a gray level value of the modulated data R'G'B' and supplies the selected gamma voltage to the data lines DL1 to DLm. The data driver 104 reverses the polarity of the analog video signals supplied to the data lines DL in response to a polarity control signal (POL) supplied from the timing controller 108.

Figure 4:
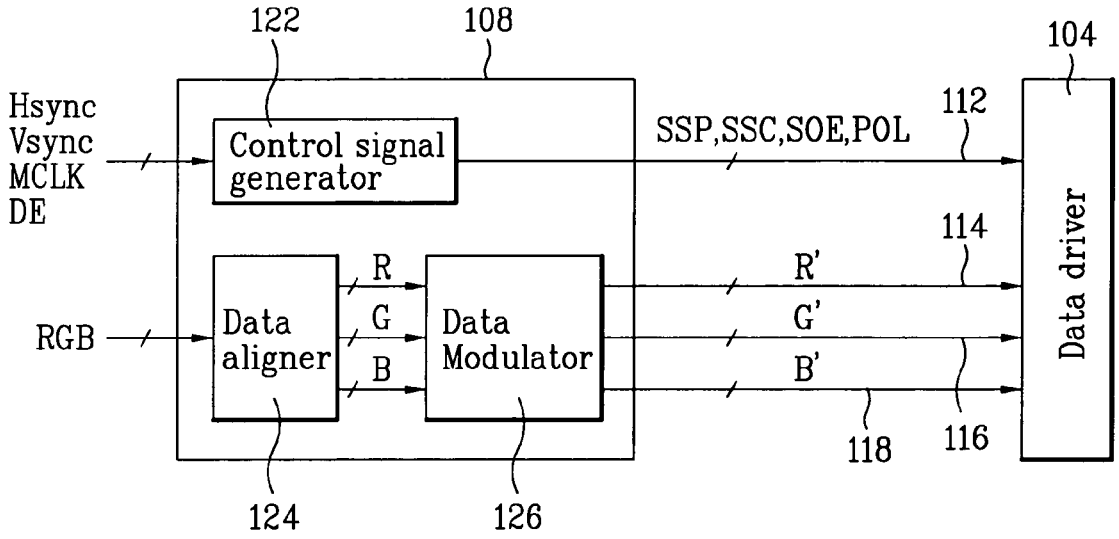
FIG. 4 illustrates data transmission between a timing controller and a data driver shown in FIG. 3.

FIG. 4 illustrates a data transmission bus between the timing controller and the data driver shown in FIG. 3.

Referring to FIG. 4 in connection with FIG. 3, the timing controller 108 includes a control signal generator 122 generating the control signals DCS and GCS, a data aligner 124 aligning the source data RGB, and a data modulator 126 inverting the low data bit excluding the MSB data in response to the MSB data of the aligned data RGB and supplying them to the data driver 104.

The control signal generator 122 generates the gate control signals GCS (GSC, GSP and GOE) and the data control signals DCS (SSC, SSP, SOE, and POL) using the main clock MCLK, the data enable signal DE, and the horizontal and vertical synchronizing signals Hsync and Vsync, which are externally input.

The gate control signals GCS are supplied to the gate driver 106 through respective transmission lines included in a gate control signal bus (not shown). The data control signals DCS are supplied to the data driver 104 through respective transmission lines included in a data control signal bus 112.

The data aligner 124 aligns the externally input source RGB data to be suitable for a bus transmission manner and supplies the aligned data to the data modulator 126. For the example illustrated, the source RGB data are 6-data bit. The source RGB data may be 6-data bit or greater.

The data modulator 126 modulates the low data bit excluding the MSB data in response to the MSB data of the data RGB aligned from the data aligner 124 and synchronizes the modulated data with the source shift clock signal SSC to transmit them to the data driver 104. In this case, the data modulator 126 supplies red, green and blue data R'G'B' including the MSB data D5 of the aligned data RGB and the modulated data bit D0 to D4' to the data driver 104 through red, green and blue data buses 114, 116 and 118, respectively. At this time, each of the red, green and blue data buses 114, 116 and 118 is comprised of six data transmission lines. As a result, the number of the data transmission lines becomes 18.

Figure 5:
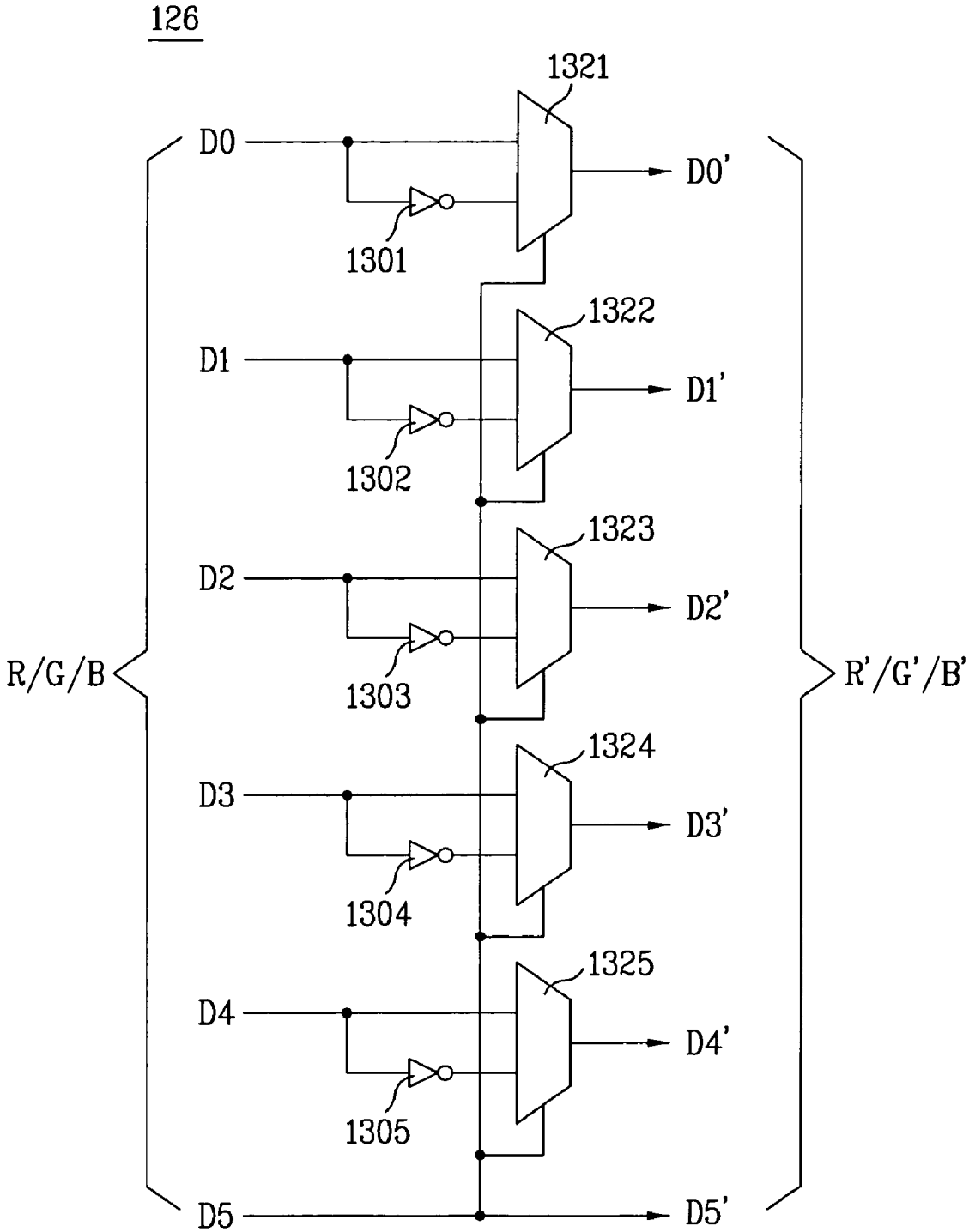
FIG. 5 illustrates a data modulator shown in FIG. 4.

To this end, the data modulator 126, as shown in FIG. 5, includes first to fifth inverters 1301 to 1305 connected to first to fifth data bit D0 to D4 input lines excluding a sixth data bit D5 transmission line, and first to fifth multiplexers 1321 to 1325 selecting one of the data bit from the first to fifth data bit input lines in response to the sixth data bit and the data bit inverted from the inverters 1301 to 1305 and transmitting the selected one to the data driver 104 through each data transmission line.

First, each of R, G and B data aligned from the data aligner 124 is supplied to the first to sixth data bit input lines.

Each of the inverters 1301 to 1305 is electrically connected to the first to fifth data bit input lines to invert the first to fifth data bit and supply the inverted data to each of the multiplexers 1321 to 1325.

Each of the multiplexers 1321 to 1325 includes a first input terminal electrically connected to the first to fifth data bit input lines, a second input terminal electrically connected to an output terminal of each of the inverters 1301 to 1305, and a control terminal electrically connected to the sixth data bit input line. The sixth data bit D5 supplied to the sixth data bit input line controls each of the multiplexers 1321 to 1325 and at the same time is supplied to the data driver 104.

Each of the multiplexers 1321 to 1325 selects the data bit supplied to one of the first and second input terminals in response to the sixth data bit D5 supplied to the sixth data bit input line, and outputs the selected data bit. In other words, as shown in Table 2, each of the multiplexers 1321 to 1325 transmits the data bit D0 to D4 supplied to the first input terminal to the data driver 104 through the data transmission line if the sixth data bit D5 is "0". By contrast, each of the multiplexers 1321 to 1325 transmits the inverted data bit D0 to D4 supplied to the second input terminal to the data driver 104 through the data transmission line if the sixth data bit D5 is "1".

TABLE 2

| | bit Grey level | | | | | |
|---|---|---|---|---|---|---|
| | D5 | D4 | D3 | D2 | D1 | D0 |
| 0 | 0 | 0 | 0 | 0 | 0 | 0 |
| 1 | 0 | 0 | 0 | 0 | 0 | 1 |
| 2 | 0 | 0 | 0 | 0 | 1 | 0 |
| . | . | . | . | . | . | . |
| . | . | . | . | . | . | . |
| . | . | . | . | . | . | . |
| 29 | 0 | 1 | 1 | 1 | 0 | 1 |
| 30 | 0 | 1 | 1 | 1 | 1 | 0 |
| 31 | 0 | 1 | 1 | 1 | 1 | 1 |
| 32 | 1 | 1 | 1 | 1 | 1 | 1 |
| 33 | 1 | 1 | 1 | 1 | 1 | 0 |
| 34 | 1 | 1 | 1 | 1 | 0 | 1 |
| . | . | . | . | . | . | . |
| . | . | . | . | . | . | . |
| . | . | . | . | . | . | . |
| 61 | 1 | 0 | 0 | 0 | 1 | 0 |
| 62 | 1 | 0 | 0 | 0 | 0 | 1 |
| 63 | 1 | 0 | 0 | 0 | 0 | 0 |

Therefore, the data modulator 126, as shown in Table 2, inverts the first to fifth data bit D0 to D4 in response to the sixth data bit D5 and transmits the inverted data bit to the data driver 104. As a result, it is possible to reduce the number of times of data transition to reach half during data transmission. For example, if the first to sixth aligned data bit D0 to D5 are "000000"~"011111," the sixth data bit D5 is "0". Therefore, the data modulator 126 transmits the data supplied from the first to sixth data bit input lines and selected by each of the multiplexers 1321 to 1325 to the data driver 104. By contrast, if the first to sixth aligned data bit D0 to D5 are "100000"~"111111," the sixth data bit D5 is "1". Therefore, the data modulator 126 transmits the data inverted by each of the inverters 1301 to 1305 and selected by each of the multiplexers 1321 to 1325 to the data driver 104.

Figure 6:
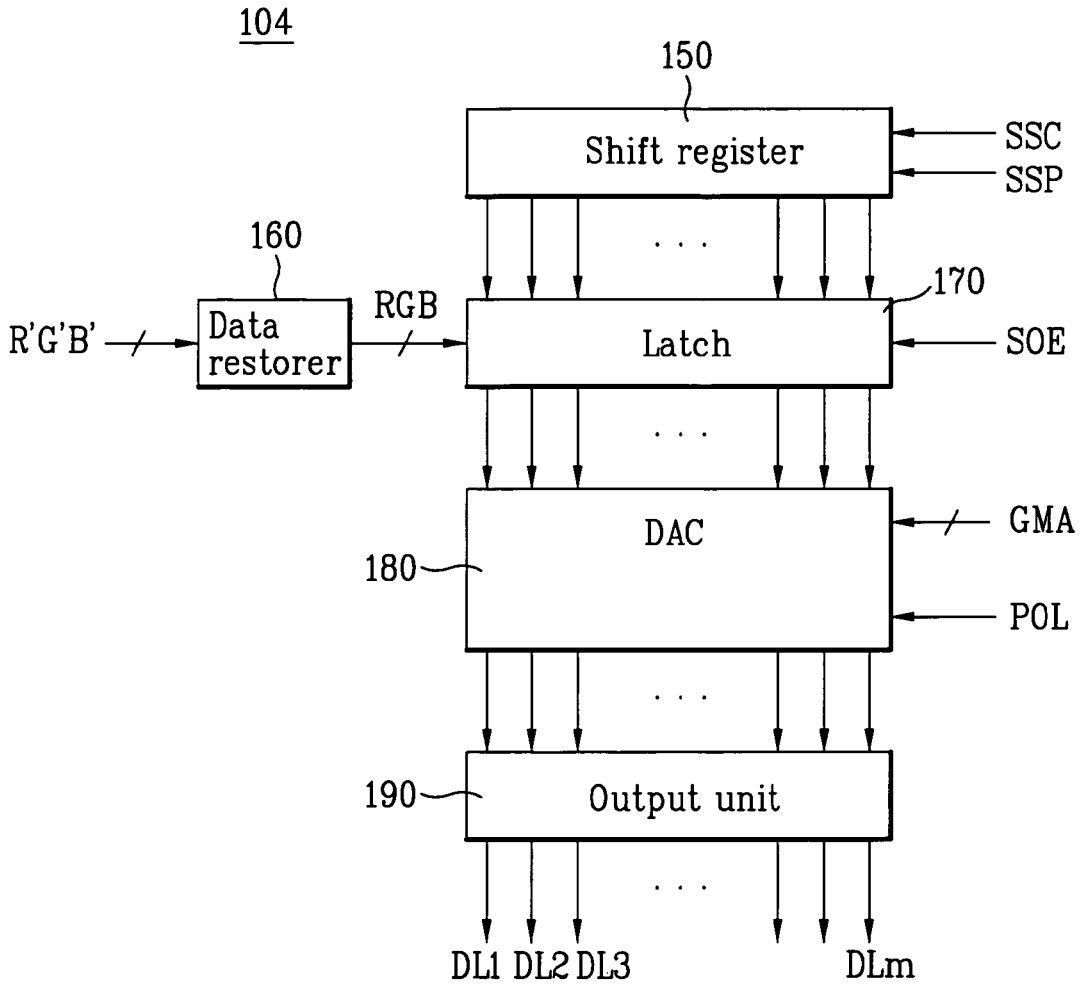
FIG. 6 is a block diagram illustrating a data driver shown in FIG. 3.

FIG. 6 is a block diagram illustrating the data driver shown in FIG. 3.

Referring to FIG. 6 in connection with FIG. 5, the data driver 104 includes a shift register 150 sequentially generating sampling signals, a data restorer 160 restoring the data R'G'B' modulated from the data modulator 126 to their original data RGB, a latch 170 latching the data RGB restored from the data restorer 160 in response to the sampling signals, a digital-to-analog converter (DAC) 180 selecting one of a plurality of gamma voltages GMA in response to the latched data RGB to generate the analog video signals, and an output unit 190 buffering the analog video signals to supply them to the data lines.

The shift register 150 sequentially generates the sampling signals using the source start pulse (SSP) and the source shift clock (SSC) among the data control signals from the timing controller 108 and supplies them to the latch 170.

The data restorer 160 inverts the first to fifth data bit in response to the MSB data, i.e., the sixth data bit among the modulated data R'G'B' transmitted from the data modulator 126 through the data transmission lines and restores inverted data to their original data RGB.

The latch 170 latches the data RGB restored from the data restorer 160 per one horizontal line in response to the sampling signals from the shift register 150. The latch 170 supplies the latched data RGB of one horizontal line to the DAC 180 in response to the source output enable (SOE) signal among the data control signals DCS from the timing controller 108.

The DAC 180 converts the data RGB into the analog video signals by selecting one of a plurality of gamma voltages GMA supplied from a gamma voltage generator (not shown) in response to the data RGB supplied from the latch 170, and supplies the converted analog video signals to the output unit 190.

The output unit 190 amplifies the analog video signals considering load of the data lines and supplies them to their corresponding data lines.

Figure 7:
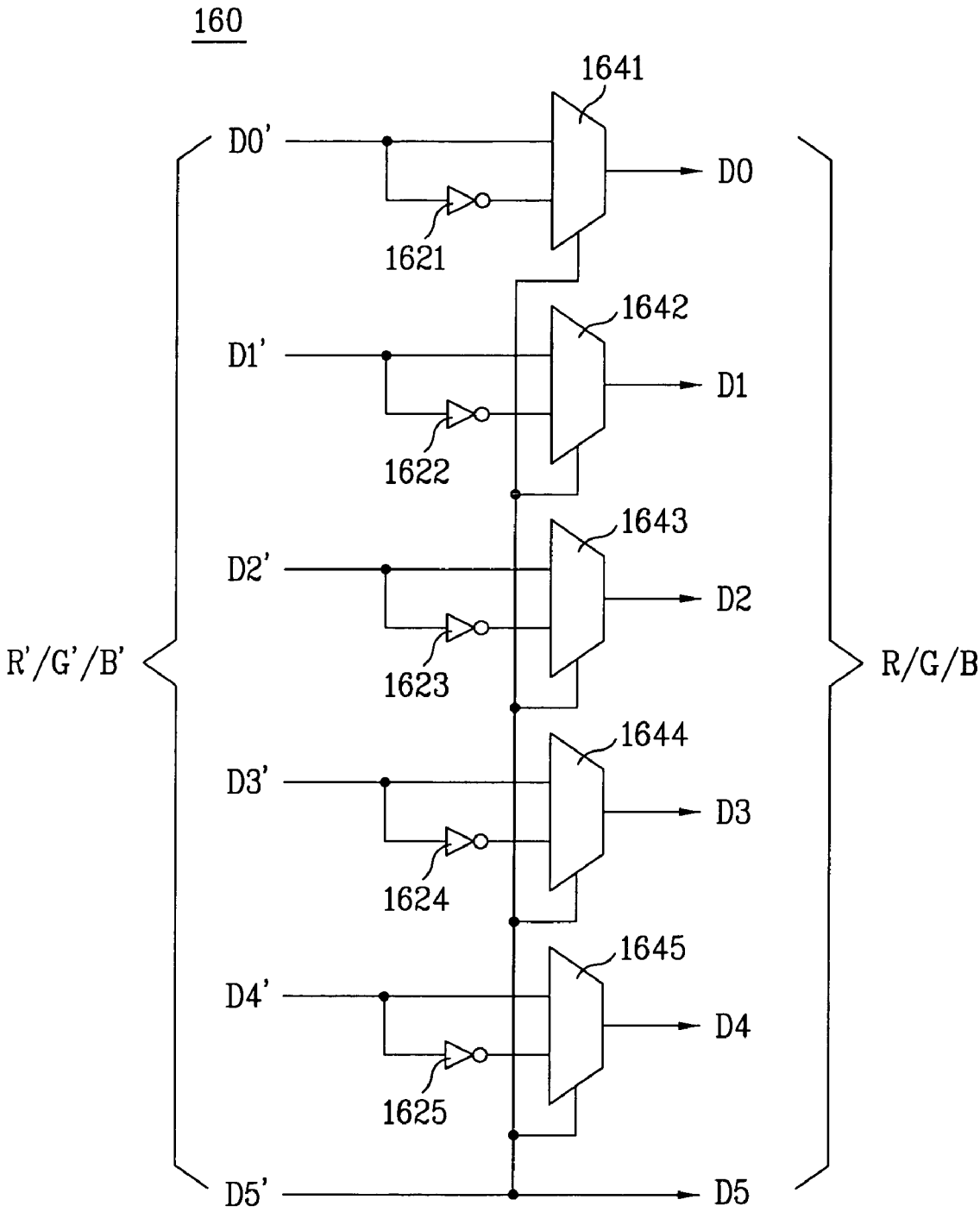
FIG. 7 illustrates a data restorer shown in FIG. 6.

FIG. 7 illustrates the data restorer shown in FIG. 6.

Referring to FIG. 7 in connection with FIG. 6, the data restorer 160 includes first to fifth inverters 1621 to 1625 connected to first to fifth modulated data bit D0' to D4' transmission lines excluding a sixth data bit D5' transmission line, and first to fifth multiplexers 1641 to 1645 selecting one of the data bit from the modulated first to fifth data bit transmission lines in response to the sixth data bit D5' and the data bit inverted from the inverters 1621 to 1625 and supplying the selected one to the latch 170.

First, each of the R, G and B data modulated from the data modulator 126 is supplied to the data restorer 160 through the first to sixth data bit transmission lines.

Each of the inverters 1621 to 1625 is electrically connected to the first to fifth data bit transmission lines to invert the first to fifth data bits D0' to D4' and supply the inverted data to each of the multiplexers 1641 to 1645.

Each of the multiplexers 1641 to 1645 includes a first input terminal electrically connected to the first to fifth data bit transmission lines, a second input terminal electrically connected to an output terminal of each of the inverters 1621 to 1625, and a control terminal electrically connected to the sixth data bit transmission line. The sixth data bit D5' supplied to the sixth data bit transmission line controls each of the multiplexers 1641 to 1645 and at the same time is supplied to the latch 170.

Each of the multiplexers 1641 to 1645 selects the data bit supplied to one of the first and second input terminals in response to the MSB, i.e., the sixth data bit D5' supplied to the sixth data bit transmission line, and outputs the selected data bit. In other words, each of the multiplexers 1641 to 1645 transmits the data bits D0' to D4' supplied to the first input terminal to the latch 170 if the sixth data bit D5' is "0". By contrast, each of the multiplexers 1641 to 1645 transmits the inverted data bits D0 to D4 supplied to the second input terminal to the latch 170 if the sixth data bit D5' is "1".

Therefore, the data restorer 160 inverts the first to fifth modulated data bits D0' to D4' in response to the sixth data bit D5' to restore their original data RGB and supplies the restored data RGB to the latch 170. For example, if the first to sixth data bits D0' to D5' are "000000"~"011111," the sixth data bit D5 is "0". Therefore, the data restorer 160 transmits the data supplied from the first to sixth data bits transmission lines and selected by each of the multiplexers 1641 to 1645 to the latch 170. By contrast, if the first to sixth data bits D0' to D5' are "100000"~"111111," the sixth data bit D5 is "1". Therefore, the data restorer 160 transmits the data inverted by each of the inverters 1621 to 1625 and selected by each of the multiplexers 1641 to 1645 to the latch 170.

In the apparatus for data transmission and the apparatus for driving the image display device using the same according to the first embodiment of the present invention, the low data bits excluding the MSB data are inverted in response to the MSB data of the input data so that the number of times of data transition can be reduced to reach half, thereby minimizing electromagnetic interference.

Figure 8:
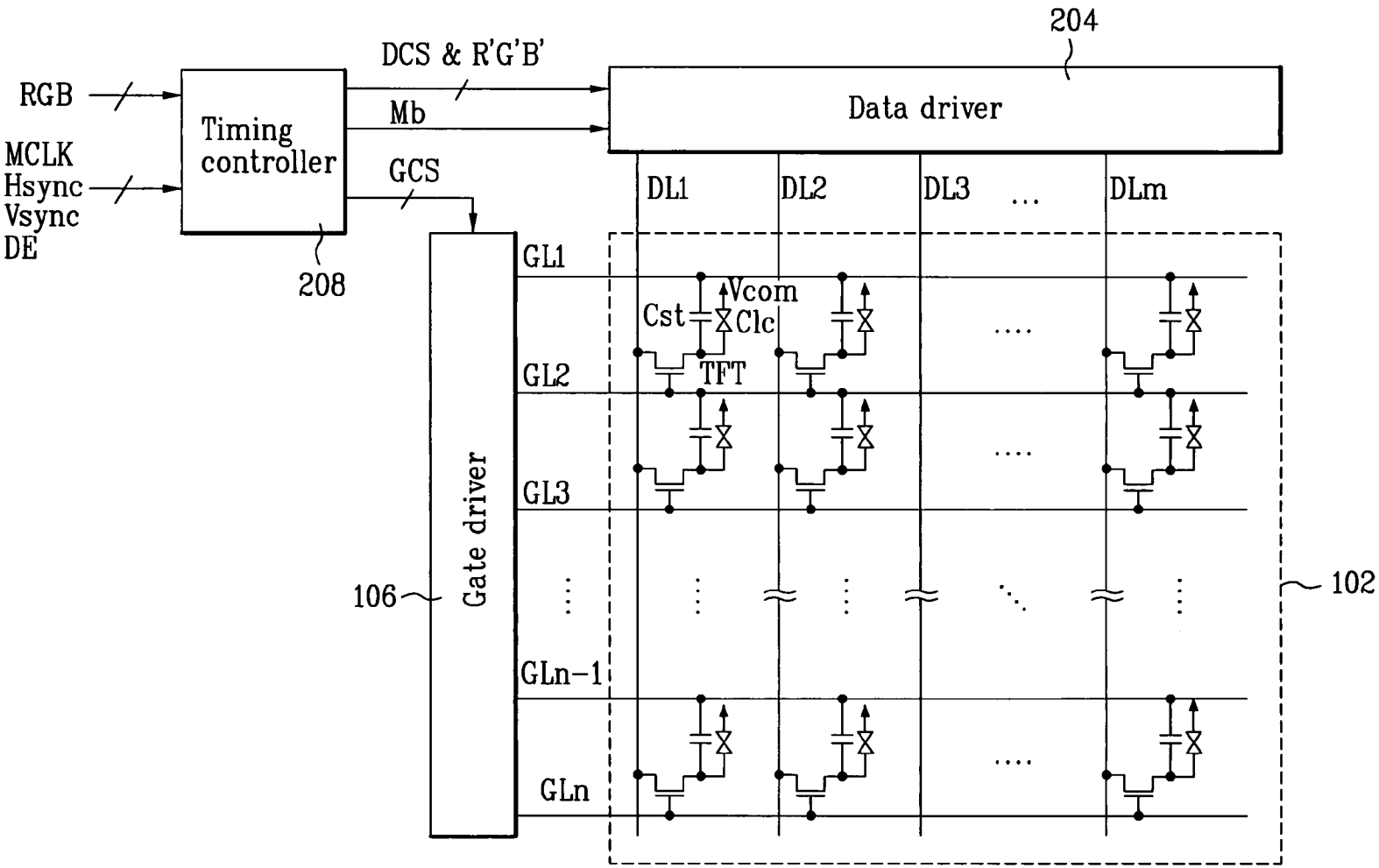
FIG. 8 illustrates an apparatus for data transmission and an apparatus for driving an image display device using the same according to the second embodiment of the present invention.

FIG. 8 illustrates an apparatus for data transmission and an apparatus for driving an image display device using the same according to the second embodiment of the present invention.

Referring to FIG. 8, the apparatus for data transmission and the apparatus for driving an image display device using the same according to the second embodiment of the present invention include an image display unit 102 including liquid crystal cells formed in each region defined by first to nth gate lines GL1 to GLn and first to mth data lines DL1 to DLm, a timing controller 208 aligning externally input source RGB data and modulating low data bits excluding the MSB data in response to the MSB data of the aligned data RGB, a gate driver 106 supplying scan pulses to the gate lines GL1 to GLn under the control of the timing controller 208, and a data driver 204 restoring the data transmitted from the timing controller 208 to their original data in response to the MSB data and converting the restored data into analog video signals under the control of the timing controller 208 to supply them to the data lines DL1 to DLm.

The aforementioned apparatus for data transmission and the apparatus for driving an image display device using the same according to the second embodiment of the present invention have the same configuration as those of the first embodiment of the present invention excluding the timing controller 208 and the data driver 204. Therefore, the timing controller 208 and the data driver 204 according to the second embodiment of the present invention will be described.

Figure 9:
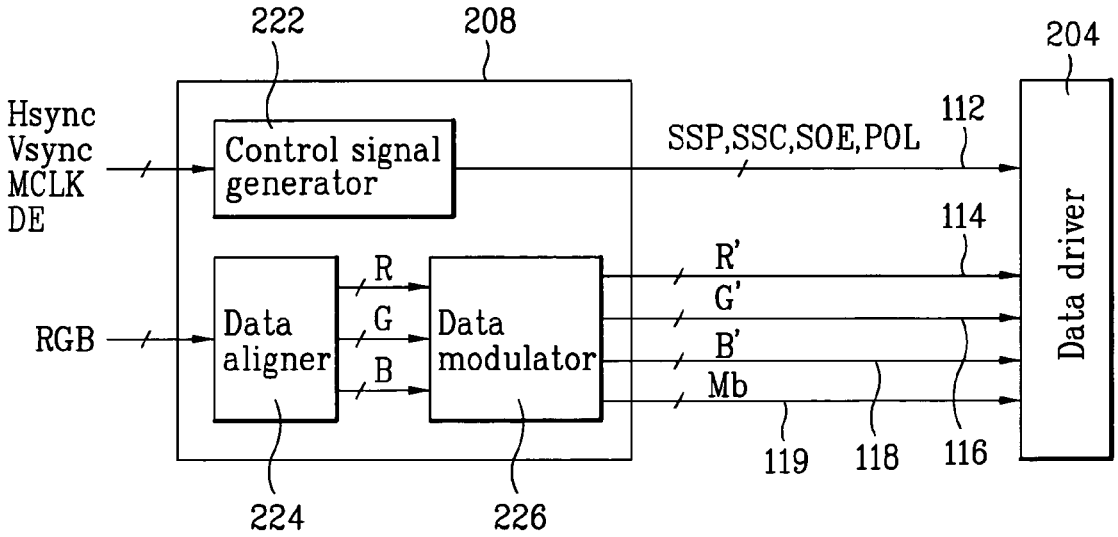
FIG. 9 illustrates data transmission between a timing controller and a data driver shown in FIG. 8.

FIG. 9 illustrates a data transmission bus between the timing controller and the data driver shown in FIG. 8.

Referring to FIG. 9 in connection with FIG. 8, the timing controller 208 includes a control signal generator 222 generating the control signals DCS and GCS, a data aligner 224 aligning the source RGB data, and a data modulator 226 modulating the low data bits excluding the MSB data in response to the MSB data of the aligned data RGB and supplying them to the data driver 204.

The control signal generator 222 generates the gate control signals GCS (GSC, GSP, and GOE) and the data control signals DCS (SSC, SSP, SOE and POL) using the main clock MCLK, the data enable signal DE, and the horizontal and vertical synchronizing signals Hsync and Vsync, which are externally input.

The gate control signals GCS are supplied to the gate driver 106 through respective transmission lines included in a gate control signal bus (not shown). The data control signals DCS are supplied to the data driver 204 through respective transmission lines included in a data control signal bus 112.

The data aligner 224 aligns the externally input source RGB data to be suitable for a bus transmission manner and supplies the aligned data to the data modulator 226. In this case, it is supposed that the source RGB data are 6-data bit. The source RGB data may be 6-data bit or greater.

The data modulator 226 modulates the low data bits excluding the MSB data using masking data Mb set in response to the MSB data of the data RGB aligned from the data aligner 224, synchronizes the modulated data with the source shift clock signal SSC, and transmits the resultant data to the data driver 204. In this case, the masking data Mb are 5-data bit previously set to minimize data transition during data transmission. For example, the masking data Mb have data bits of "00101".

Furthermore, the data modulator 226 supplies red, green and blue data R'G'B' including the MSB data D5 of the aligned data RGB and the modulated data bits D0' to D4' to the data driver 204 through red, green and blue data buses 114, 116 and 118. At this time, each of the red, green and blue data buses 114, 116 and 118 is comprised of six data transmission lines. As a result, the number of the data transmission lines becomes 18.

The data modulator 226 supplies the masking data Mb to the data driver 204 through a masking data transmission line 119.

Figure 10:
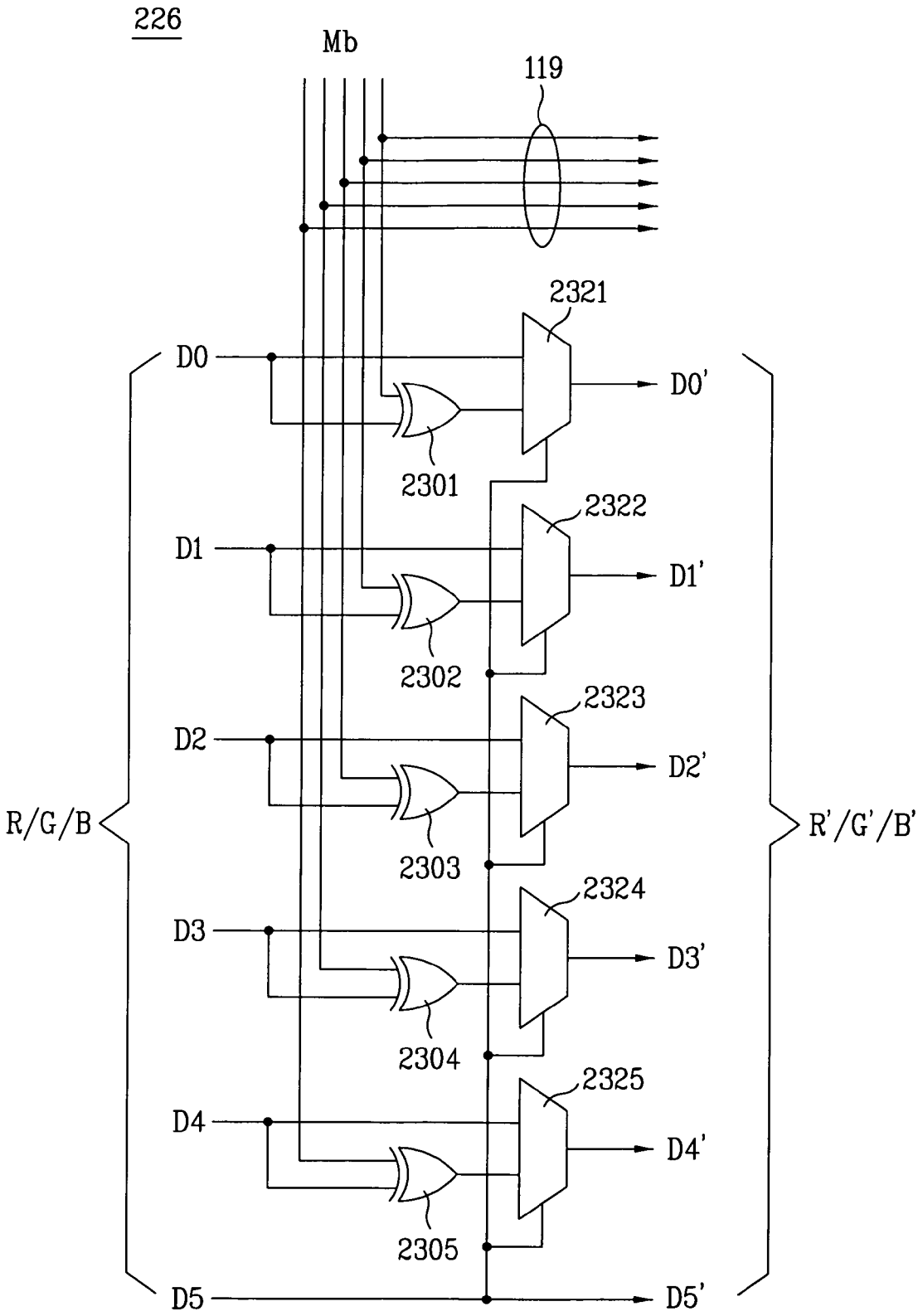
FIG. 10 illustrates a data modulator shown in FIG. 9.

To this end, the data modulator 226, as shown in FIG. 10, includes first to fifth exclusive OR gates XOR 2301 to 2305 connected to the masking data transmission line 119 and the first to fifth data bit input lines excluding the sixth data bit input line, and first to fifth multiplexers 2321 to 2325 selecting one of the data bits from the first to fifth data bit input lines in response to the sixth data bit D5 and the data bits modulated from each of the exclusive OR gates 2301 to 2305 and transmitting the selected one to the data driver 204 through each data transmission line.

First, each of R, G and B data aligned from the data aligner 224 is supplied to the first to sixth data bit input lines.

Each of the exclusive OR gates 2301 to 2305 is electrically connected to the first to fifth data bit input lines and the masking data transmission line 119 to perform an exclusive OR operation on the first to fifth data bits and the masking data Mb and supply the resultant data to each of the multiplexers 2321 to 2325. For example, if the first data bit D0 differs from the first masking data bit of the masking data Mb, the first exclusive OR gate 2301 supplies the data bit of "1" to the first multiplexer 2321. By contrast, if this is not the case, the first exclusive OR gate 2301 supplies the data bit of "0" to the first multiplexer 2321.

Each of the multiplexers 2321 to 2325 includes a first input terminal electrically connected to the first to fifth data bit input lines, a second input terminal electrically connected to an output terminal of each of the exclusive OR gates 2301 to 2305, and a control terminal electrically connected to the sixth data bit transmission line. The sixth data bit D5 supplied to the sixth data bit input line controls each of the multiplexers 2321 to 2325 and at the same time is supplied to the data driver 204.

Each of the multiplexers 2321 to 2325 selects the data bit supplied to one of the first and second input terminals in response to the MSB, i.e., the sixth data bit D5 supplied to the sixth data bit input line, and outputs the selected data bit. In other words, as shown in Table 2, each of the multiplexers 2321 to 2325 transmits the data bits D0 to D4 supplied to the first input terminal to the data driver 204 through the data transmission line if the sixth data bit D5 is "0". By contrast, each of the multiplexers 2321 to 2325 transmits the exclusive OR operated data bits D0 to D4 supplied to the second input terminal to the data driver 204 if the sixth data bit D5 is "1".

As described above, the data modulator 226 performs exclusive OR operation of the masking data Mb and the first to fifth data bits D0 to D4 in response to the sixth data bit D5 and transmits the exclusive OR operated data to the data driver 204. As a result, it is possible to reduce the number of times of data transition more remarkably during data transmission. For example, if the first to sixth aligned data bits D0 to D5 are "000000"~"011111," the sixth data bit D5 is "0". Therefore, the data modulator 226 transmits the data supplied from the first to sixth data bit input lines and selected by each of the multiplexers 2321 to 2325 to the data driver 204. By contrast, if the first to sixth aligned data bit D0 to D5 are "100000"~"111111," the sixth data bit D5 is "1". Therefore, the data modulator 226 transmits the exclusive OR operated data of the masking data Mb and the first to fifth data bits D0 to D5, which are selected by each of the multiplexers 2321 to 2325, to the data driver 204.

Figure 11:
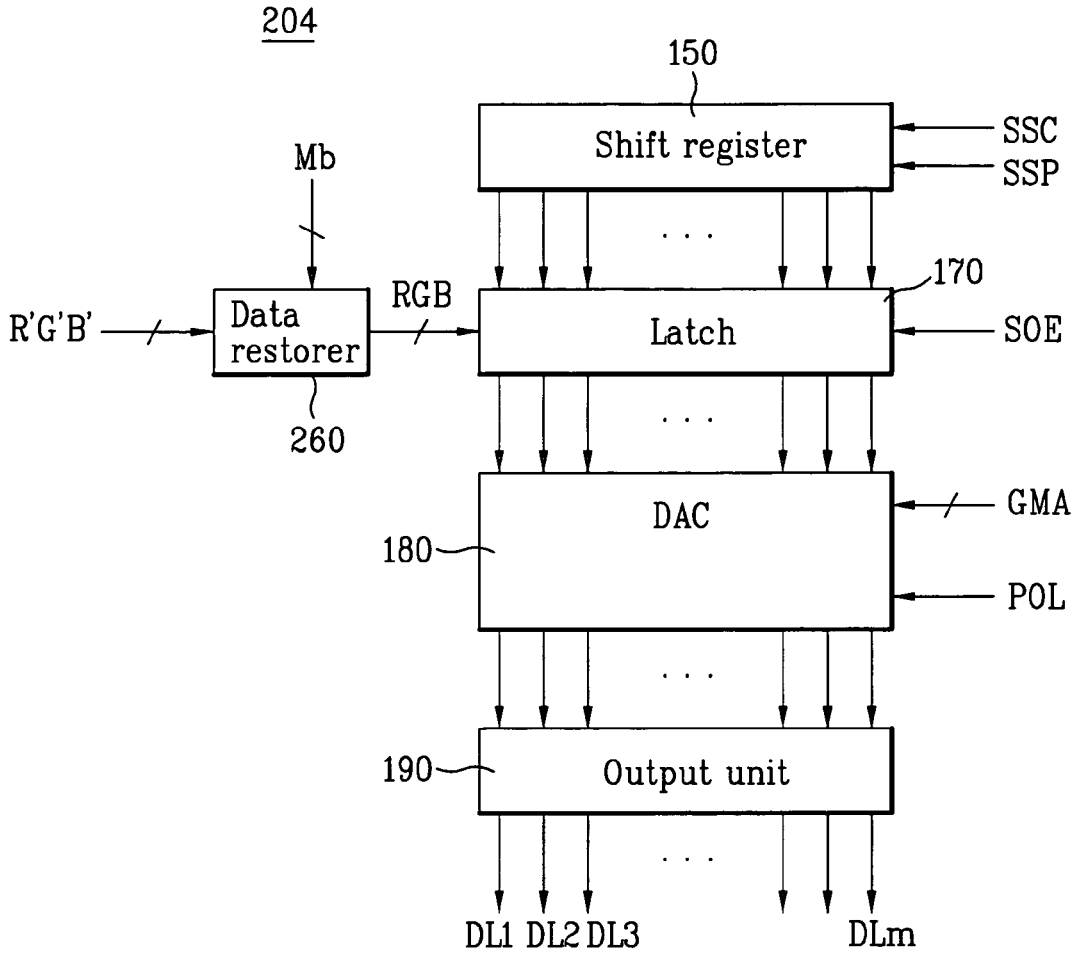
FIG. 11 is a block diagram illustrating a data driver shown in FIG. 8.

FIG. 11 is a block diagram illustrating the data driver shown in FIG. 8.

Referring to FIG. 11 in connection with FIG. 8, the data driver 204 includes a shift register 150 sequentially generating sampling signals, a data restorer 260 restoring the data R'G'B' modulated from the data modulator 126 to their original data RGB, a latch 170 latching the data RGB restored from the data restorer 260 in response to the sampling signals, a digital-to-analog converter (DAC) 180 selecting one of a plurality of gamma voltages GMA in response to the latched data RGB to generate the analog video signals, and an output unit 190 buffering the analog video signals to supply them to the data lines.

The data driver 204 has the same configuration as the data driver 104 shown in FIG. 6 excluding the data restorer 260. Therefore, the data restorer 260 will now be described.

The data restorer 260 restores the first to fifth data bits D0' to D4' to their original data RGB using the masking data Mb from the data modulator 226 in response to the MSB data, i.e., the sixth data bit among the modulated data R'G'B' transmitted from the data modulator 226.

Figure 12:
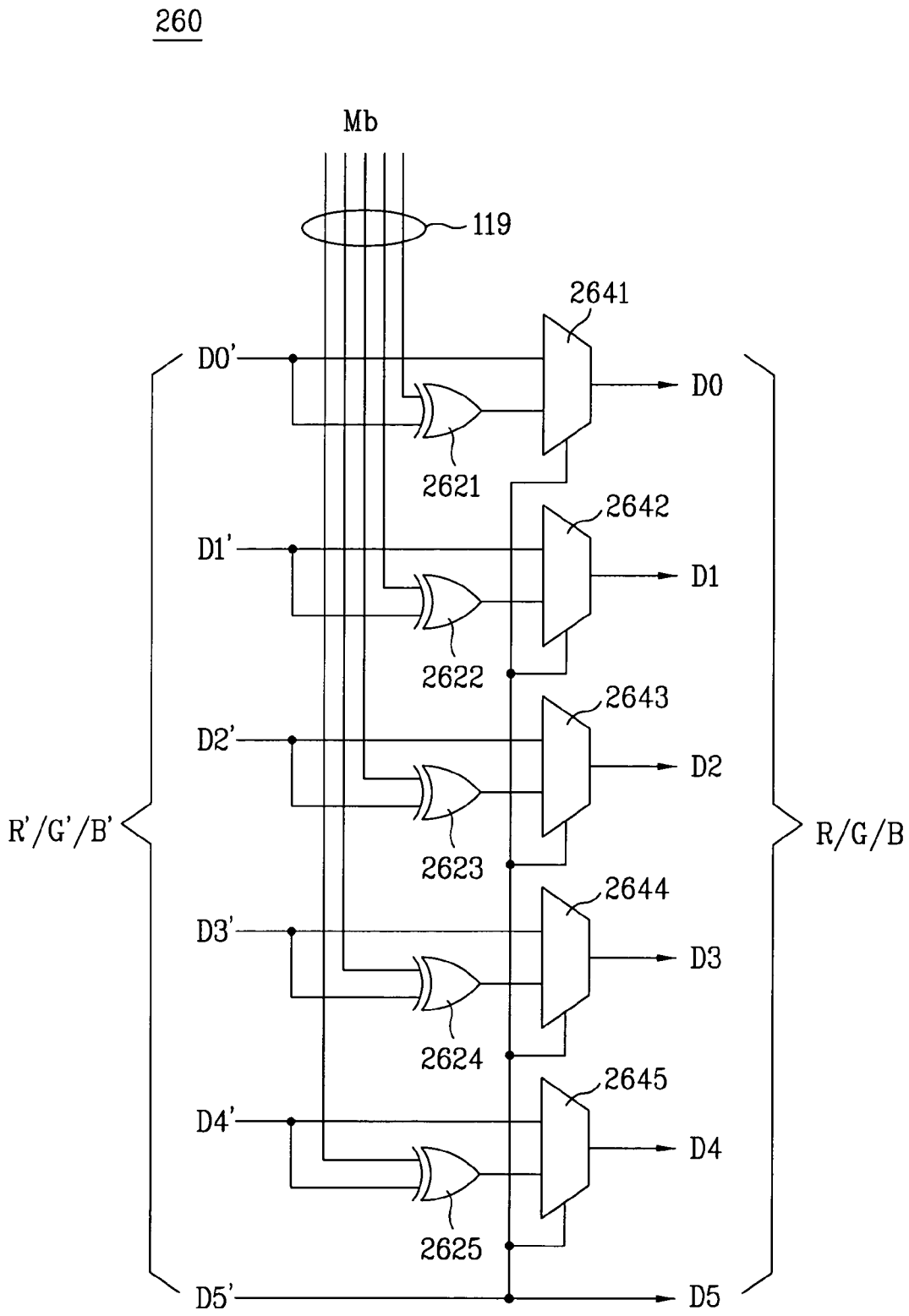
FIG. 12 illustrates a data restorer shown in FIG. 11.

To this end, the data restorer 260, as shown in FIG. 12, includes first to fifth exclusive OR gates 2621 to 2625 connected to the masking data transmission line and the first to fifth modulated data bit D0' to D4' transmission lines excluding the sixth data bit D5' transmission line, and first to fifth multiplexers 2641 to 2645 selecting one of the data bits from the first to fifth data bit transmission lines in response to the sixth data bits D5' and the data bits from each of the exclusive OR gates 2621 to 2625 and transmitting the selected one to the latch 170.

First, each of R, G and B data modulated from the data modulator 226 is supplied to the data restorer 260 through the first to sixth data bit transmission lines.

Each of the exclusive OR gates 2621 to 2625 is electrically connected to the first to fifth data bit D0 to D4 transmission lines and the masking data transmission line 119 to perform an exclusive OR operation of the first to fifth modulated data bit D0' to D4' and the masking data Mb and supply the resultant data to each of the multiplexers 2641 to 2645. For example, if the first data bit D0' differs from the first masking data bit of the masking data Mb, the first exclusive OR gate 2621 supplies the data bit of "1" to the first multiplexer 2641. By contrast, if not so, the first exclusive OR gate 2621 supplies the data bit of "0" to the first multiplexer 2641.

Each of the multiplexers 2641 to 2645 includes a first input terminal electrically connected to the first to fifth data bit D0 to D4 transmission lines, a second input terminal electrically connected to an output terminal of each of the exclusive OR gates 2621 to 2625, and a control terminal electrically connected to the sixth data bit transmission line. The sixth data bit D5 supplied to the sixth data bit transmission line controls each of the multiplexers 2641 to 2645 and at the same time is supplied to the latch 170.

Each of the multiplexers 2641 to 2645 selects the data bit supplied to one of the first and second input terminals in response to the MSB, i.e., the sixth data bit D5' supplied to the sixth data bit transmission line, and outputs the selected data bit. In other words, as shown in Table 2, each of the multiplexers 2641 to 2645 transmits the data bit D0 to D4 supplied to the first input terminal to the latch 170 if the sixth data bit D5' is "0". By contrast, each of the multiplexers 2641 to 2645 transmits the exclusive OR operated data bit D0 to D4 supplied to the second input terminal to the latch 170 if the sixth data bit D5' is "1".

As described above, the data restorer 260 performs exclusive OR operation of the masking data Mb and the first to fifth data bit D0' to D4' in response to the sixth data bit D5' and transmits the exclusive OR operated data to the latch 170. As a result, it is possible to reduce the number of times of data transition more remarkably during data transmission. For example, if the first to sixth modulated data bit D0' to D5' are "000000"~"011111," the sixth data bit D5' is "0". Therefore, the data restorer 260 transmits the data supplied from the first to fifth data bit D0' to D4' transmission lines and selected by each of the multiplexers 2641 to 2645 to the latch 170. By contrast, if the first to sixth modulated data bit D0' to D5' are "100000"~"111111," the sixth data bit D5' is "1". Therefore, the data restorer 260 transmits the exclusive OR operated data of the masking data Mb and the first to fifth data bit D0' to D5', which are selected by each of the multiplexers 2641 to 2645, to the latch 170.

In the apparatus for data transmission and the apparatus for driving the image display device using the same according to the second embodiment of the present invention, the low data bit excluding the MSB data undergo exclusive OR operation along with the masking data in response to the MSB data of the input data so that the number of times of data transition can be reduced more remarkably during data transmission, thereby minimizing electromagnetic interference.

The aforementioned apparatus for data transmission and the apparatus for driving the image display device using the same according to the first and second embodiments of the present invention may be used for a light-emitting display device having light-emitting cells or a plasma display panel having discharge cells in addition to the LCD panel having liquid crystal cells.

As described above, in the aforementioned apparatus and method for data transmission and the apparatus and method for driving the image display device using the same according to the preferred embodiments of the present invention, the low data bit excluding the MSB data are inverted in response to the MSB data of the input data so that the number of times of data transition can be reduced to reach half, thereby minimizing electromagnetic interference.

In addition, the low data bit excluding the MSB data undergo exclusive OR operation along with the masking data in response to the MSB data of the input data so that the number of times of data transition can be reduced more remarkably during data transmission, thereby minimizing electromagnetic interference.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for data transmission comprising:

a data modulator modulating low bits excluding the most significant bit (MSB) of original data in response to the original MSB and outputting the modulated low bits along with the original MSB as the modulated data, wherein the data modulator includes a transmission line outputting the original MSB; and a data restorer receiving the modulated low bits and the original MSB output from the data modulator and restoring the modulated low bits from the data modulator to the original low bits in response to the original MSB from the data modulator and outputting the restored low bits along with the original MSB as the restored data, wherein if the original MSB is a first logic state, the data modulator outputs the original low bits along with the original MSB as the modulated data, and the data restorer outputs the original low bits along with the original MSB from the data modulator as the restored data, and wherein if the original MSB is a second logic state, the data modulator inverts the original low bits and then output the inverted low bits along with the original MSB as the modulated data, and the data restorer restores the inverted low bits from the data modulator into the original low bits and then outputs the restored low bits along with the original MSB as the restored data.

2. The apparatus as claimed in claim 1, wherein the data modulator includes:

a plurality of data input lines to which the original data are input;

a plurality of first inverters inverting the original low bits input to each of the data input lines; and a plurality of first selectors selecting one of the original low bits from each of the data input lines and the low bit inverted by each of the first inverters in response to the original MSB and outputting the selected one to a plurality of data transmission lines.

3. The apparatus as claimed in claim 2, wherein the data restorer includes:

a plurality of second inverters inverting the low bits transmitted to each of the data transmission lines;

a plurality of second selectors selecting one of the low bits from each of the data transmission lines and the low bit inverted by each of the second inverters in response to the original MSB; and an output line outputting the original MSB.

4. The apparatus as claimed in claim 1, wherein the data modulator modulates the original low bits in response to the original MSB using input masking data.

5. The apparatus as claimed in claim 4, wherein the data modulator includes:

a plurality of data input lines to which the original data are input;

a plurality of masking data transmission lines supplied with the masking data;

a plurality of first logic gates performing a logic operation on the original low bits input to each of the data input lines and the masking data;

a plurality of first selectors selecting one of the original low bits from each of the data input lines and the low bit operated by each of the first logic gates in response to the original MSB and outputting the selected one to a plurality of data transmission lines; and a transmission line outputting the original MSB.

6. The apparatus as claimed in claim 5, wherein the first logic gates are exclusive OR gates.

7. The apparatus as claimed in claim 5, wherein the data restorer includes:

a plurality of second logic gates performing a logic operation on the low bits transmitted to each of the data transmission lines and the masking data;

a plurality of second selectors selecting and outputting one of the low bits from each of the data transmission lines and the low bit operated by each of the second logic gates in response to the original MSB; and an output line outputting the original MSB.

8. The apparatus as claimed in claim 7, wherein the second logic gates are exclusive OR gates.

9. An apparatus for driving an image display device comprising:

an image display unit including pixel cells formed in each region defined by a plurality of gate lines and a plurality of data lines;

a timing controller including a data modulator modulating low bits excluding the MSB of original data in response to the original MSB and outputting the modulated low bits along with the original MSB as the modulated data, wherein the data modulator includes a transmission line outputting the original MSB;

a gate driver supplying scan pulses to the gate lines under the control of the timing controller; and a data driver including a data restorer receiving the modulated low bits and the original MSB output from the data modulator and restoring the modulated low bits from the timing controller to the original low bits in response to the original MSB from the timing controller and outputting the restored low bits along with the original MSB as the restored data, and a digital-to-analog converter (DAC) converting the restored data into analog video signals under the control of the timing controller to supply them to the data lines, wherein if the original MSB is a first logic state, the data modulator outputs the original low bits with the original MSB as the modulated data, and the data restorer outputs the original low bits along with the original MSB from the data modulator as the restored data, and wherein if the original MSB is a second logic state, the data modulator inverts the original low bits and then output the inverted low bits along with the original MSB as the modulated data, and the data restorer restores the inverted low bits from the data modulator into the original low bits and then outputs the restored low bits along with the original MSB as the restored data.

10. The apparatus as claimed in claim 9, wherein the timing controller includes:

a control signal generator generating control signals for controlling the gate driver and the data driver; and a data aligner aligning the original data to be suitable for driving the image display unit and outputting the aligned data to the data modulator.

11. The apparatus as claimed in claim 10, wherein the data modulator includes:

a plurality of data input lines to which the original data are input;

a plurality of first inverters inverting the original low bits input to each of the data input lines; and a plurality of first selectors selecting one of the original low bits from each of the data input lines and the low bit inverted by each of the first inverters in response to the original MSB and outputting the selected one to a plurality of data transmission lines.

12. The apparatus as claimed in claim 11, wherein the data driver further includes:

a shift register sequentially generating sampling signals; and a latch latching the restored data from the data restorer in response to the sampling signals and outputting the latched data to the DAC.

13. The apparatus as claimed in claim 12, wherein the data restorer includes:

a plurality of second inverters inverting the low bits transmitted to each of the data transmission lines;

a plurality of first selectors selecting one of the low bits from each of the data transmission lines and the low bit inverted by each of the second inverters in response to the original MSB; and an output line outputting the original MSB.

14. The apparatus as claimed in claim 10, wherein the data modulator modulates the original low bits in response to the original MSB using input masking data.

15. The apparatus as claimed in claim 14, wherein the data modulator includes:

a plurality of data input lines to which the original data are input;

a plurality of masking data transmission lines supplied with the masking data;

a plurality of first logic gates performing logic operation of original the low bits input to each of the data input lines and the masking data;

a plurality of second selectors selecting one of the original low bits from each of the data input lines and the low bit operated by each of the first logic gates in response to the original MSB and outputting the selected one to a plurality of data transmission lines; and a transmission line outputting the original MSB.

16. The apparatus as claimed in claim 15, wherein the first logic gates are exclusive OR gates.

17. The apparatus as claimed in claim 15, wherein the data driver includes:

a shift register sequentially generating sampling signals; and a latch latching the restored data from the data restorer in response to the sampling signals and outputting the latched data to the DAC.

18. The apparatus as claimed in claim 17, wherein the data restorer includes:

a plurality of second logic gates performing logic operation of the low bits transmitted to each of the data transmission lines and the masking data;

a plurality of second selectors selecting one of the low bits from each of the data transmission lines and the low bit operated by each of the second logic gates in response to the original MSB; and an output line outputting the original MSB.

19. The apparatus as claimed in claim 18, wherein the second logic gates are exclusive OR gates.

20. A method for data transmission comprising:

a) modulating low bits excluding the MSB of original data in response to the original MSB and outputting the modulated low bits along with the original MSB as the modulated data; and b) receiving the modulated low bits and the original MSB output from a data modulator and restoring the modulated low bits from the data modulator to the original low bits in response to the original MSB and outputting the restored low bits along with the original MSB as the restored data, wherein if the original MSB is a first logic state, the original low bits are output along with the original MSB as the modulated and the restored data, and wherein if the original MSB is a second logic state, the original low bits are inverted and then the inverted low bits are output along with the original MSB as the modulated data, and the inverted low bits are restored into the original low bits and then the restored low bits are output along with the original MSB as the restored data.

21. The method as claimed in claim 20, wherein the step a) includes:

inverting the original low bits input from a plurality of data input lines; and selecting one of the original low bits from each of the data input lines and the inverted low bit in response to the original MSB and outputting the selected one along with the original MSB to a plurality of data transmission lines.

22. The method as claimed in claim 21, wherein the step b) includes:

inverting the low bits transmitted to each of the data transmission lines; and selecting one of the low bits from each of the data transmission lines and the inverted low bit in response to the original MSB and outputting the selected one along with the original MSB.

23. The method as claimed in claim 20, wherein the step a) includes modulating the original low bits in response to the original MSB using input masking data.

24. The method as claimed in claim 23, wherein the step a) includes:

a1) performing logic operation of the original low bits input to each of the data input lines and the masking data; and a2) selecting one of the original low bits from each of the data input lines and the operated low bit in response to the original MSB and outputting the selected one along with the original MSB to a plurality of data transmission lines.

25. The method as claimed in claim 24, wherein the step b) includes:

b1) performing logic operation of the low bits transmitted to each of the data transmission lines and the masking data; and b2) selecting one of the low bits from each of the data transmission lines and the low bit operated by each of the second logic gates in response to the original MSB and outputting the selected one along with the original MSB.

26. The method as claimed in claim 25, wherein the logic operation is exclusive OR operation.

27. A method for driving an image display device including pixel cells formed in each region defined by a plurality of gate lines and a plurality of data lines, the method comprising:

c) modulating low bits excluding the MSB of original data in response to the original MSB and outputting the modulated low bits along with the original MSB as the modulated data;

d) receiving the modulated low bits and the original MSB output from a data modulator and restoring the modulated low bits from the data modulator to the original low bits in response to the original MSB and outputting the restored low bits along with the original MSB as the restored data;

e) supplying scan pulses to the gate lines; and f) converting the restored data into analog video signals to synchronize with the scan pulses and supplying the analog video signals to the data lines, wherein if the original MSB is a first logic state, the original low bits are output along with the original MSB as the modulated and the restored data, and wherein if the original MSB is a second logic state, the original low bits are inverted and then the inverted low bits are output along with the original MSB as the modulated data, and the inverted low bits are restored into the original low bits and then the restored low bits are output along with the original MSB as the restored data.

28. The method as claimed in claim 27, wherein the step c) includes:

c1) inverting the original low bits input from a plurality of data input lines; and c2) selecting one of the original low bits from each of the data input lines and the inverted low bit in response to the original MSB and outputting the selected one along with the original MSB to a plurality of data transmission lines.

29. The method as claimed in claim 28, wherein the step d) includes:

d1) inverting the low bits input to each of the data transmission lines; and d2) selecting one of the low bits from each of the data transmission lines and the inverted low bit in response to the original MSB and outputting the selected one along with the original MSB.

30. The method as claimed in claim 27, wherein the step f) includes substeps:

f1) sequentially generating sampling signals;

f2) latching the restored data in response to the sampling signals; and f3) converting the latched data into the analog video signals to output them to the data lines.

31. The method as claimed in claim 27, wherein the step c) includes modulating the original low bits in response to the original MSB using masking data.

32. The method as claimed in claim 31, wherein the step c) includes:

performing logic operation of the original low bits input to each of the data input lines and the masking data; and selecting one of the original low bits from each of the data input lines and the operated low bit in response to the original MSB and outputting the selected one along with the original MSB to a plurality of data transmission lines.

33. The method as claimed in claim 32, wherein the step d) includes:

performing logic operation of the low bits transmitted to each of the data transmission lines and the masking data; and selecting one of the low bits from each of the data transmission lines and the operated low bit in response to the original MSB and outputting the selected one along with the original MSB.

34. The method as claimed in claim 33, wherein the logic operation is exclusive OR operation.

35. The method as claimed in claim 31, wherein the step f) includes:

sequentially generating sampling signals;

latching the restored data in response to the sampling signals; and converting the latched data into the analog video signals to output them to the data lines.

* * * * *